US010892126B2

(12) United States Patent
Sherrima

(10) Patent No.: US 10,892,126 B2
(45) Date of Patent: Jan. 12, 2021

(54) METHOD OF PRODUCING A TEMPERATURE-TRIGGERED FUSE DEVICE

(71) Applicant: Manufacturing Networks Incorporated (MNI), Santa Clara, CA (US)

(72) Inventor: Faraj Sherrima, Santa Clara, CA (US)

(73) Assignee: Manufacturing Networks Incorporated (MNI), Santa Clara, CA (US)

( * ) Notice: Subject to any disclaimer, the term of this patent is extended or adjusted under 35 U.S.C. 154(b) by 105 days.

(21) Appl. No.: 16/128,518

(22) Filed: Sep. 12, 2018

(65) Prior Publication Data

US 2019/0013167 A1 Jan. 10, 2019

Related U.S. Application Data

(62) Division of application No. 15/499,873, filed on Apr. 27, 2017, now Pat. No. 10,566,164.

(51) Int. Cl.
*H01H 69/02* (2006.01)
*H01H 85/046* (2006.01)
(Continued)

(52) U.S. Cl.
CPC ..... *H01H 69/022* (2013.01); *H01H 37/761* (2013.01); *H01H 85/046* (2013.01);
(Continued)

(58) Field of Classification Search
CPC ..... H01L 2224/11; Y10T 29/49155; Y10T 83/04; Y10T 29/49144; Y10T 29/49107; Y10T 156/10; H05K 2203/0759; H05K 3/246; H05K 3/4661; B23K 35/0222; C23C 18/1605; H01R 13/6666
(Continued)

(56) References Cited

U.S. PATENT DOCUMENTS 4,344,061 A 8/1982 Niwa
7,106,165 B2 * 9/2006 Mukai ..... H01H 37/761 337/401

(Continued)

*Primary Examiner* — Thiem D Phan
(74) *Attorney, Agent, or Firm* — Invent Capture, LLC.; Samuel S. Cho

(57) ABSTRACT

A novel temperature-triggered fuse device is configured to be activated at a designer-specified ambient temperature by utilizing wetting force among a pair of wetting material bays and a solder bridge or a solder ball. The solder bridge or the solder ball is typically positioned on top of the pair of wetting material bays separated by an electrically-insulated gap. Preferably, the wetting material bays are at least partly made of gold, nickel, or other elements suitable for generating an increased wetting force to the solder bridge or the solder ball upon increases in ambient temperature. The novel temperature-triggered fuse device can be integrated into various types of integrated circuits (IC's), or can function as a discrete fuse connected to one or more electronic components for robust protection from power surges and/or thermal runaway-related device malfunctions, meltdowns, or explosions. Various methods of producing the temperature-triggered fuse device are also disclosed herein.

5 Claims, 8 Drawing Sheets

(51) Int. Cl.
*H01H 37/76* (2006.01)
*H01H 85/041* (2006.01)
*H01H 85/143* (2006.01)

(52) U.S. Cl.
CPC ... *H01H 85/143* (2013.01); *H01H 2085/0412* (2013.01); *H01H 2085/0414* (2013.01); *Y10T 29/49107* (2015.01)

(58) Field of Classification Search
USPC ..... 29/623, 428, 610.1, 846, 860, 874, 875
See application file for complete search history.

(56) References Cited

U.S. PATENT DOCUMENTS

| | | | | |
|---|---|---|---|---|
| 7,554,432 | B2 | 6/2009 | Graf et al. | |
| 2008/0237884 | A1 * | 10/2008 | Hsu | H01L 23/498 257/774 |
| 2009/0108983 | A1 | 4/2009 | Darr et al. | |
| 2012/0255162 | A1 | 10/2012 | Tamura | |

* cited by examiner

500A

500B

500C

500D

600A

600B

600E

600F

700A

700B

700C

METHOD OF PRODUCING A TEMPERATURE-TRIGGERED FUSE DEVICE

BACKGROUND OF THE INVENTION

The present invention generally relates to power protection fuses for electronic circuits and electrical devices. More specifically, the invention relates to one or more embodiments of temperature-triggered fuse devices. Furthermore, the invention also relates to one or more embodiments of manufacturing such temperature-triggered fuse devices.

Modern electrical devices typically incorporate power-protection fuses to prevent an unexpected and/or undesirable power surge from damaging various components associated with such electrical devices. Many electrical devices operate in environments susceptible to unwanted and dangerous power surges or accidental reverse polarity input connections. If power surges (e.g. a voltage surge, a current surge, or both) are sufficiently high or prolonged beyond a negligible duration, electrical devices subject to power surges can sustain operation failure or permanent damages.

Therefore, protection against power surges have been commonly addressed by conventional power-protection fuses. Some fuses are one-time devices that may need to be replaced when activated, while other fuses are resettable. Regardless of one-time use or resettable characteristics, a conventional power-protection fuse is generally configured to monitor an operating current and/or an operating voltage of an electrical circuit connected to the conventional power-protection fuse, and is subsequently activated (i.e. blows the fuse to disconnect at least a portion of the electrical circuit, or clamps the operating voltage or current to a lower magnitude), when the operating current and/or the operating voltage exceeds or surges above a defined safe-operation threshold value. Typically, current or voltage surge above the defined safe-operation threshold value may damage, endanger, and/or overheat the electrical circuit connected to the fuse, unless the fuse is activated to disconnect the electrical circuit or to lower the operating voltage or current to a lower magnitude.

Conventional fuses that are often incorporated in integrated circuits (IC's) for power protection include transient voltage suppression (TVS) circuits, which protect IC's from accidental or undesirable high voltage spikes in the IC's. Examples of TVS circuits include electrostatic discharge (ESD) protection diodes. Conventional TVS protection circuits comprise two or more diodes, at least one of which is designed to conduct electricity temporarily in case of a high-voltage surge event. TVS circuits are typically designed to clamp the voltage to a particular voltage value during a power surge event, and are also designed to endure an accompanying current surge through the TVC circuits, thereby protecting the load which comprises integrated circuitry requiring protection from power surges.

However, some dangerous electrical device failures that result in gradual or sudden overheating of an electrical device, which may cause a deadly meltdown or explosion of the electrical device itself, cannot always be properly detected by merely monitoring the device operating voltage or current. For example, a mobile device with a malfunctioning battery or a malfunctioning charger may still exhibit a normal range of operating voltage and current levels, even as the temperature of the malfunctioning battery undergoes a thermal runaway to the point of the device meltdown or explosion. Conventional power-protection fuses that are designed to be triggered based on device voltage and/or current threshold levels alone are thus sometimes inaccurate or inappropriate for safeguarding against certain types of device malfunctions, such as device thermal runaway meltdowns or explosions.

Therefore, it may be advantageous to devise a novel electronic component structure as a novel fuse device, which enables real-time temperature-triggered circuit and device protection at a specified ambient temperature near the novel fuse device. It may also be advantageous to devise the novel fuse device as an integration-friendly component that can be easily incorporated into a variety of integrated circuits, circuit boards, and electrical device casings. Furthermore, it may also be advantageous to devise one or more novel device fabrication steps and methods for manufacturing the novel fuse device.

SUMMARY

Summary and Abstract summarize some aspects of the present invention. Simplifications or omissions may have been made to avoid obscuring the purpose of the Summary or the Abstract. These simplifications or omissions are not intended to limit the scope of the present invention.

In one embodiment of the invention, a temperature-triggered fuse device for protection against power surges and thermal runaways in an electronic circuit is disclosed. This temperature-triggered fuse device comprises: a base substrate; a first metal pad and a second metal pad located on top of the base substrate or on a sputtered seed layer on top of the base substrate, wherein the first metal pad and the second metal pad are separated by an electrically-insulating material; a first wetting material bay located on top of the first metal pad; a second wetting material bay located on top of the second metal pad; an electrically-insulated gap positioned above the electrically-insulating material; and a solder bridge or a solder ball physically and electrically connecting the first wetting material bay and the second wetting material bay across the electrically-insulated gap, wherein the solder bridge or the solder ball is configured to break apart or melt due to a wetting force generated by the first wetting material bay and the second wetting material bay, when an ambient threshold temperature is reached in the temperature-triggered fuse device.

In another embodiment of the invention, a method for producing a temperature-triggered fuse device is disclosed. This method comprises the steps of: placing a first metal pad and a second metal pad on top of a base substrate, wherein the first metal pad and the second metal pad are separated by an electrically-insulating material; depositing a first de-wetting material coating on a portion of the first metal pad and a second de-wetting material coating on a portion of the second metal pad; depositing a first wetting material bay on a remaining portion of the first metal pad and a second wetting material bay on a remaining portion of the second metal pad; and placing a solder bridge or a solder ball across the first wetting material bay and the second wetting material bay, wherein the solder bridge or the solder ball forms a gap with the electrically-insulating material that separates the first metal pad and the second metal pad.

Yet in another embodiment of the invention, a plating manufacturing method for producing a temperature-triggered fuse device is disclosed. This plating manufacturing method comprises the steps of: sputtering a base seed layer on top of a base substrate; applying a photoresist on the base seed layer; forming patterns on the photoresist by utilizing a photomask, wherein the patterns identify a first piece of the base seed layer and a second piece of the base seed layer, which are separated by a gap; plating a first metal pad on the first piece of the base seed layer and a second metal pad on the second piece of the base seed layer; etching areas covered by the photoresist to remove corresponding underlying portions of the base seed layer; cleaning the areas and removing photoresist residues after etching; depositing a de-wetting material coating on a topmost surface; applying a passivation mask to identify metal exposure locations on the first metal pad and the second metal pad for removal of the de-wetting material coating; etching the de-wetting material coating from the metal exposure locations; cleaning the metal exposure locations; depositing a wetting bay seed layer on the topmost surface; applying a gap mask to identify the gap separating the first piece of the base seed layer and the second piece of the base seed layer for removal of a portion of the wetting bay seed layer above the gap; etching the portion of the wetting bay seed layer above the gap; applying a solder bridge mask to identify a solder bridge location; plating solder to form the solder bridge at the solder bridge location across the gap, wherein the solder bridge connects separated pieces of the wetting bay seed layer; and etching portions of the wetting bay seed layer above the de-wetting material coating.

DETAILED DESCRIPTION

Figure 1:
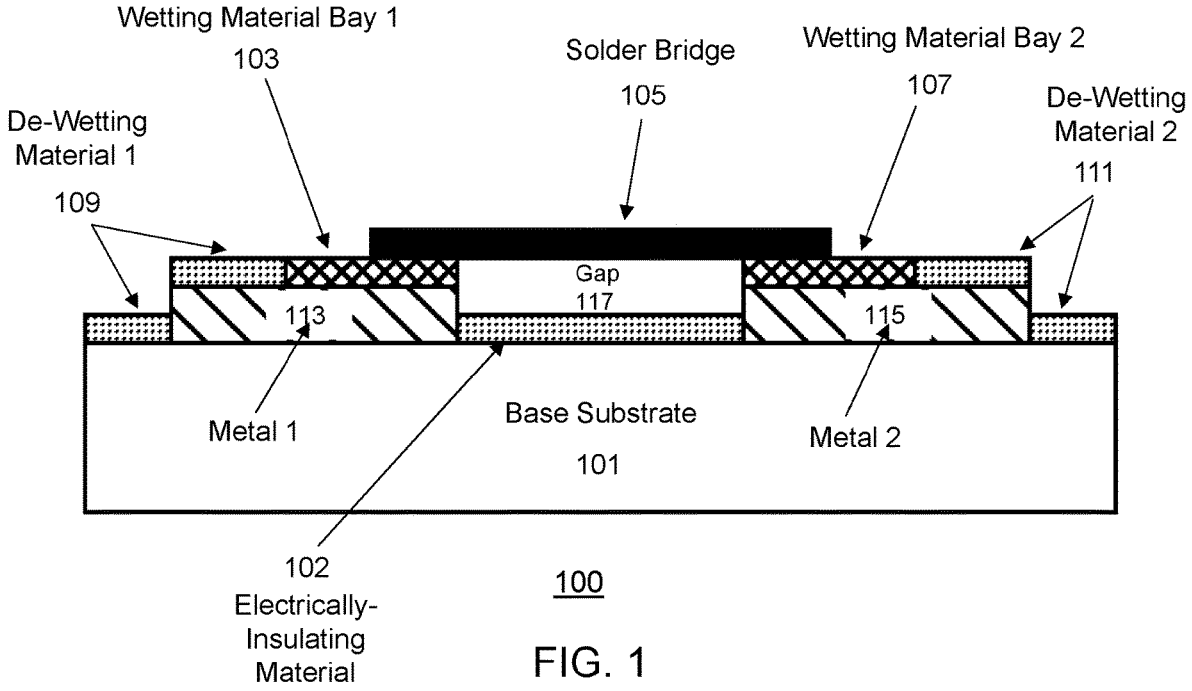
FIG. 1 shows a cross sectional view of a device structure of a novel temperature-triggered fuse device when a solder bridge is intact before wetting force is sufficiently increased to break the solder bridge apart, in accordance with an embodiment of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

The detailed description is presented largely in terms of description of shapes, configurations, and/or other symbolic representations that directly or indirectly resemble a novel chip structure and/or a manufacturing method for a temperature-triggered fuse device. These descriptions and representations are the means used by those experienced or skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment. Furthermore, separate or alternative embodiments are not necessarily mutually exclusive of other embodiments. Moreover, the order of blocks in process flowcharts or diagrams representing one or more embodiments of the invention do not inherently indicate any particular order nor imply any limitations in the invention.

For the purpose of describing the invention, a term described herein as a "fuse" or a "fuse device" is defined as a special-purpose apparatus, which is designed to protect a circuit or another electronic component from malfunctions or damages due to undesirable power surges and/or thermal runaways. A fuse may be an integrated electronic component to an integrated circuit (IC's) or a discrete component operatively connected to IC's or other electronic components.

Moreover, for the purpose of describing the invention, a term described herein as "wetting force" is defined as a net pulling or pushing force resulting from intermolecular interactions among one or more wetting materials and a solder bridge or a solder ball at varying temperatures. In a preferred embodiment of the invention, as ambient temperature increases to a threshold temperature for activating a temperature-triggered fuse, the wetting force generated by intermolecular tensions among wetting material(s) (e.g. gold (Au), nickel gold (Ni/Au), copper gold (Cu/Au)) on a metallic substrate and a solder bridge or a solder ball, which connects a pair of wetting materials separated by an air gap, becomes sufficiently strong enough to break off the solder bridge or the solder ball.

Furthermore, for the purpose of describing the invention, a term described herein as a "solder bridge" or a "solder ball" is defined as a temperature-specific breakable electrical connection element between a first wetting material bay and a second wetting material bay. Typically, a solder bridge or a solder ball is positioned above an air gap, which is configured to contain broken solder bridge or solder ball pieces when the solder bridge or the solder ball breaks apart due to an increased wetting force at a threshold temperature.

In addition, for the purpose of describing the invention, a term described herein as "power surge" or "power surge event" is defined as a spike in voltage, current, or both. An example of a power surge is a voltage or current spike at an input terminal of an electrical device caused by an external power source, an external electrical signal, or a sudden change in environment such as lightening or ESD discharging.

One aspect of an embodiment of the present invention is providing a novel electronic component structure as a novel fuse device. The novel fuse device is configured to provide real-time temperature-triggered circuit and device protection at a specified ambient temperature near the novel fuse device.

Another aspect of an embodiment of the present invention is providing an IC integration-friendly temperature-triggered fuse device that can be easily incorporated into a variety of integrated circuits, circuit boards, and electrical device casings.

In addition, another aspect of an embodiment of the present invention is providing one or more novel device fabrication steps and methods for manufacturing a temperature-triggered fuse device.

FIG. 1 shows a cross sectional view (100) of a device structure of a novel temperature-triggered fuse device when a solder bridge (105) is intact before wetting force is increased sufficiently to break the solder bridge (105) apart, in accordance with an embodiment of the invention. As shown by the cross sectional view (100), in a preferred embodiment of the invention, the novel temperature-triggered fuse device is constructed on a base substrate (101), which may be made of silicon, silicon dioxide, printed circuit board (PCB) material, or another appropriate material to be the base substrate (101).

Furthermore, a first metal pad (113) and a second metal pad (115) are positioned on top of the base substrate (101), as shown in FIG. 1. These metal pads (113, 115) are typically made of aluminum or another electrically-conductive materials to transmit electricity to wetting material bays and wire bonding pads in the novel temperature-triggered fuse device. Moreover, a first wetting material bay (103) is positioned partially on a top surface of the first metal pad (113), while a second wetting material bay (107) is positioned partially on a top surface of the second metal pad (115). Preferably, the first wetting material bay (103) and the second wetting material bay (107) are made of gold, nickel, or a combination thereof.

Continuing with FIG. 1, the novel temperature-triggered fuse device also includes a first de-wetting material bay (109) located adjacent to the first wetting material bay (103), wherein a portion of the first de-wetting material bay (109) may be on the top surface of the first metal pad (113). Likewise, the novel temperature-triggered fuse device also includes a second de-wetting material bay (111) located adjacent to the second wetting material bay (107), wherein a portion of the second de-wetting material bay (111) may be on the top surface of the second metal pad (115), as shown on FIG. 1. Preferably, the first de-wetting material bay (109) and the second de-wetting material bay (111) are both made of polymer films or another substance appropriate for passivation as de-wetting material(s). In one embodiment of the invention, the first de-wetting passivation contact area from the first de-wetting material bay (109) to the first wetting material bay (103) assists and increases a first push or pull wetting force, when a surrounding temperature rises during device operation. Likewise, the second de-wetting passivation contact area from the second de-wetting material bay (111) to the second wetting material bay (107) assists and increases a second push or pull wetting force, when the surrounding temperature rises during the device operation. The added push or pull forces generated by the first de-wetting material bay (109) and the second de-wetting material bay (111) further amplify wetting forces created by the first wetting material bay (103) and the second wetting material bay (107) in a rising temperature environment. This novel mechanism of fuse activation originating from dynamic wetting and de-wetting force interactions among wetting and de-wetting material bays (103, 109, 107, 111), in various embodiments of the invention, uniquely enables accurate and clean breakage and/or disconnection of the solder bridge (105), once the ambient threshold temperature is reached to trigger the fuse activation.

In addition, the novel temperature-triggered fuse device in accordance with the preferred embodiment of the invention also includes an electrically-insulating material (102) and an electrically-insulated gap (117) that physically separate the first metal pad (113) from the second metal pad (115). In some embodiments of the invention, the electrically-insulating material (102) may be a film made of the same chemical compound utilized for the first de-wetting material (109) and the second de-wetting material (111). In other embodiments, the electrically-insulating material (102) may be a specialized dielectric substance that is chemically distinct from other de-wetting materials in the novel temperature-triggered fuse device. In addition, the electrically-insulated gap (117) is preferably an air gap. In some other embodiments, other gasses, liquids, or solids with high electrical insulation properties may be utilized in the electrically-insulated gap (117).

Furthermore, the novel temperature-triggered fuse device also includes the solder bridge (105), which physically and electrically connects the first wetting material bay (103) and the second wetting material bay (107) across the electrically-insulated gap (117). In the preferred embodiment of the invention, the solder bridge (105) is designed to break apart, melt, and/or separate into multiple fragments when the wetting force generated by the first wetting material bay (103) and the second wetting material bay (107) is increased enough (i.e. due to a rising ambient temperature) to result in a sufficient net pulling or pushing force on the solder bridge (105) for structural breakage.

In context of the embodiment of the invention as shown in FIG. 1, the novel temperature-triggered fuse device has not yet reached an ambient threshold temperature for breakage of the solder bridge (105). Therefore, the device structure of the novel temperature-triggered fuse device, as shown in the cross sectional view (100), is able to conduct electricity across the solder bridge (105) and between the first wetting material bay (103) and the second wetting material bay (107).

Furthermore, in some embodiments of the invention, designing the temperature-triggered fuse device requires a calculated amount of solder volume, a calculated dimension of a solder ball or a solder bridge, a calculated size of the gap, and a calculated dimension of each wetting material bay to ensure a desirable structural disconnection at a desired threshold temperature.

In one example, a fuse designer may contemplate the following design considerations when estimating appropriate dimensions for certain components contained in the temperature-triggered fuse device:

The overlap between the solder bridge and the bay on each side of the gap: Ws Gap width: Wg, Gap length: lg, Solder thickness of the bridge at the gap: is Solder volume contained in the bridge structure: $Vsg=(2Ws+Wg)*lg*ts$ Upon melting, this volume will divide between the two bays Thus, volume of solder on each bay: $Vsg/2=(2Ws+Wg)*lg*ts/2$ If Ws=50 microns, Wg=50 microns, lg=100 microns, ts=70 microns, Then, $Vsg=5.25\times10\hat{}5$ If the solder ball on each bay (after melting) is to have a height of 40 microns, then the area of the bay can be estimated as:

Abay=13,125.00 square microns.

Thus, if each bay were to be a square shape, the length of each side, Lbay=114.56 microns.

Figure 2:
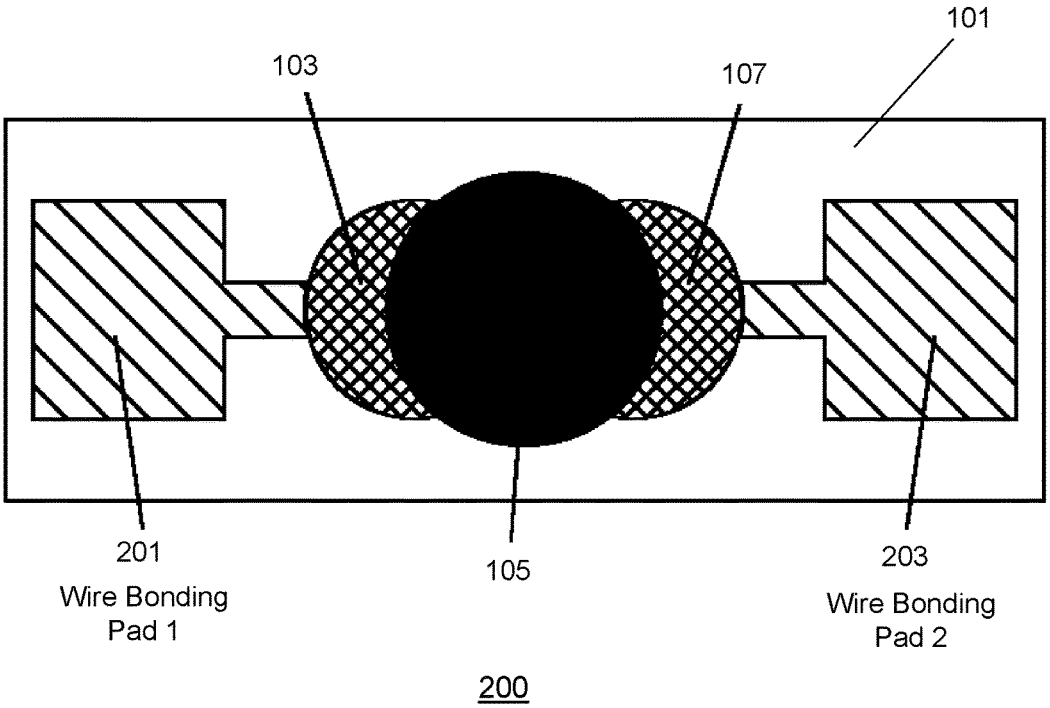
FIG. 2 shows a top view of a device structure of a novel temperature-triggered fuse device when a solder bridge is intact before a wetting force is able to break the solder bridge, in accordance with an embodiment of the invention.

FIG. 2 shows a top view (200) of a device structure of a novel temperature-triggered fuse device when the solder bridge (105) is intact before a wetting force is able to break the solder bridge (105), in accordance with an embodiment of the invention. In this top view (200) as shown in FIG. 2, the first wetting material bay (103) and the second wetting material bay (107) are electrically and physically separated by the electrically-insulated gap (117 in FIG. 1) and the electrically-insulating material (102 in FIG. 1) that are located underneath the solder bridge (105). Therefore, the two wetting material bays (103, 107) are only electrically connected to each other through the solder bridge (105).

Furthermore, as also shown in the top view (200) in FIG. 2, a first wire bonding pad (201) is electrically connected, either directly or indirectly, to the first wetting material bay (103). Likewise, a second wire bonding pad (203) is electrically connected, either directly or indirectly, to the second wetting material bay (107). In one embodiment, the electrical connection between wire bonding pads (e.g. 201, 203) and wetting material bays (e.g. 103, 107) are indirect connections that are established via adjacent metal pads (e.g. 113, 115 in FIG. 1). In another embodiment, the electrical connection between wire bonding pads (e.g. 201, 203) and wetting material bays (e.g. 103, 107) may be established directly using wires. The wire bonding pads (201, 203) enable the novel temperature-triggered fuse device to connect to an integrated circuit (IC's) and/or to another electronic component that requires protection from undesirable power surges and thermal runaway conditions during device operations.

Figure 3:
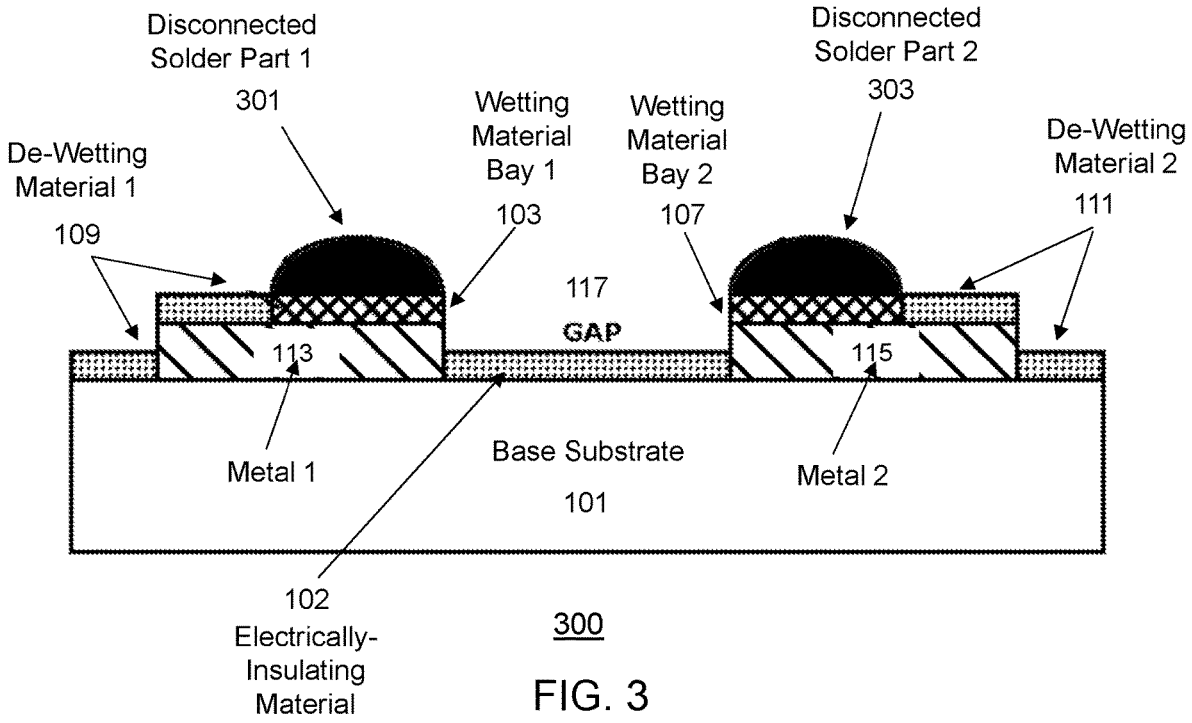
FIG. 3 shows a cross sectional view of a device structure of a novel temperature-triggered fuse device when a wetting force is sufficiently strengthened enough to break the solder bridge at a pre-specified temperature, in accordance with an embodiment of the invention.

FIG. 3 shows a cross sectional view (300) of a device structure of a novel temperature-triggered fuse device when a wetting force is sufficiently strengthened enough to break the solder bridge (e.g. 105 in FIG. 1) apart at a pre-specified temperature, in accordance with an embodiment of the invention. As shown by the cross sectional view (300), the solder bridge that previously connected the first wetting material bay (e.g. 103 in FIG. 1) and the second wetting material bay (e.g. 107 in FIG. 1) across the electrically-insulated gap (117) is now broken and/or melted into pieces (e.g. 301, 303) due to the increase of the wetting force exerted on the solder bridge at or above an ambient threshold temperature. Some broken pieces of the solder bridge may also fall into the electrically-insulated gap (117), which does not impact the electrically-disconnected status of the novel temperature-triggered fuse.

In a preferred embodiment of the invention, materials or compounds utilized for the formation of the wetting material bays are purposefully selected to generate a specific amount of wetting force on the solder bridge for breakage at a predefined ambient threshold temperature. For example, if a fuse designer intends to activate the novel temperature-triggered fuse device for electrical disconnection at 120 degree Celsius, then the fuse designer may specify a particular mixture of gold (Au) and nickel (Ni) for the wetting material bays to generate sufficient wetting force to break the solder bridge at or above 120 degree Celsius. Furthermore, the fuse designer may also choose to modify the dimensions (i.e. thickness, length, width, or height) of the solder bridge to enable a precise temperature-triggered fuse activation at a desired ambient threshold temperature level.

In context of the embodiment of the invention as shown in FIG. 3, the novel temperature-triggered fuse device has reached or exceeded an ambient threshold temperature for breakage of the solder bridge, resulting in broken, fragmented, and/or melted pieces (e.g. 301, 303). Therefore, the device structure of the novel temperature-triggered fuse device, as shown in the cross sectional view (300), is now unable to conduct electricity across the electrically-insulated gap (117), thus electrically disconnecting the first wetting material bay (103) and the second wetting material bay (107) to protect fuse-enabled integrated circuits, components, and devices from thermal runaway conditions and/or power surges.

Figure 4:
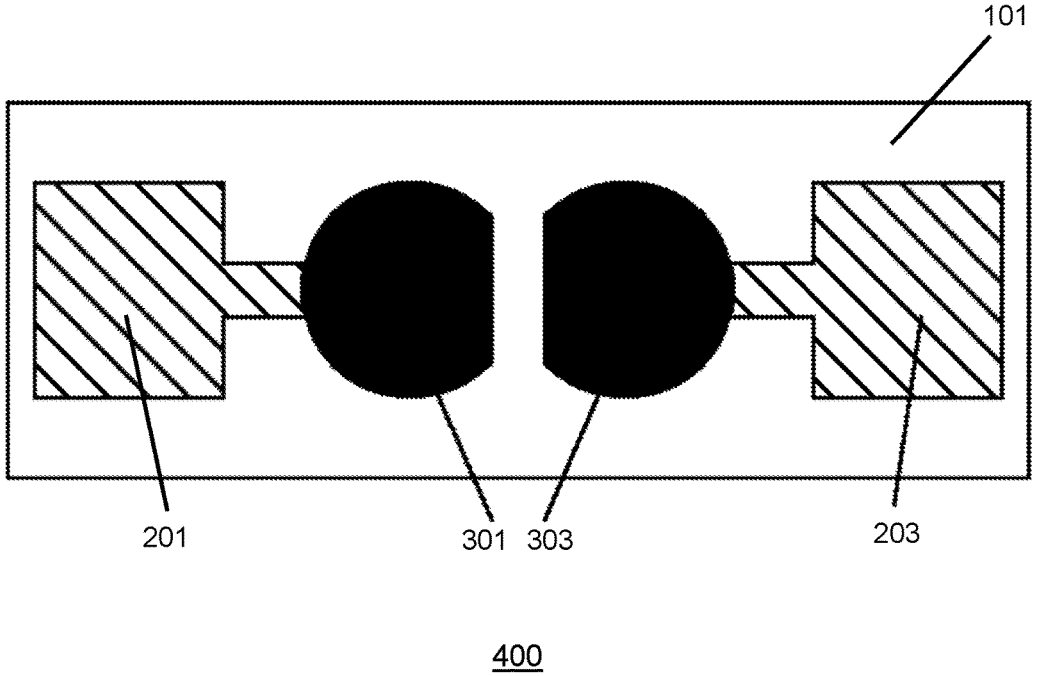
FIG. 4 shows a top view of a device structure of a novel temperature-triggered fuse device when a wetting force is sufficiently strengthened enough to break the solder bridge at a pre-specified temperature, in accordance with an embodiment of the invention.

FIG. 4 shows a top view (400) of a device structure of a novel temperature-triggered fuse device when a wetting force is sufficiently strengthened enough to break the solder bridge (105 in FIG. 2) into multiple broken pieces (301, 301) at a pre-specified temperature, in accordance with an embodiment of the invention. In this top view (400) as shown in FIG. 4, the solder bridge is now disconnected, as evidenced by a first broken solder piece (301) positioned on top of the first wetting material bay (e.g. 103 in FIG. 3), and a second broken solder piece (303) positioned on top of the second wetting material bay (e.g. 107 in FIG. 3). Therefore, the electrical connection between the two wetting material bays (e.g. 103, 107) is now disconnected, thus activating the novel temperature-triggered fuse device to protect fuse-enabled circuits, components, and/or devices.

In context of the embodiment of the invention as shown in FIG. 4, the novel temperature-triggered fuse device has reached or exceeded an ambient threshold temperature for breakage of the solder bridge, resulting in broken, fragmented, and/or melted pieces (e.g. 301, 303). Therefore, the device structure of the novel temperature-triggered fuse device, as shown in the top view (400), is now unable to conduct electricity across the electrically-insulated gap (e.g. 117 in FIG. 3), thus electrically disconnecting the first wetting material bay (e.g. 103 in FIG. 2) and the second wetting material bay (e.g. 107 in FIG. 2) to protect fuse-enabled integrated circuits, components, and devices from thermal runaway conditions and/or power surges.

Figure 5A:
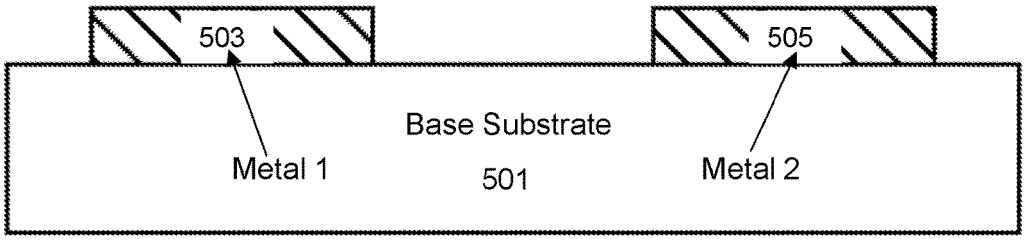
FIG. 5A~FIG. 5D show a series of manufacturing processing steps for fabricating a novel temperature-triggered fuse device, in accordance with an embodiment of the invention.

FIG. 5A~FIG. 5D show a series of manufacturing processing steps for fabricating a novel temperature-triggered fuse device, in accordance with an embodiment of the invention. As shown in FIG. 5A, the first step (500A) of this embodiment involves placing a first metal pad (503) and a second metal pad (505) on top of a base substrate (501). Typically the base substrate (501) is made of silicon, silicon dioxide, or a printed circuit board (PCB) material. Furthermore, metal pads are made of aluminum, copper, or another electrically-conductive metallic substance.

Figure 5B:
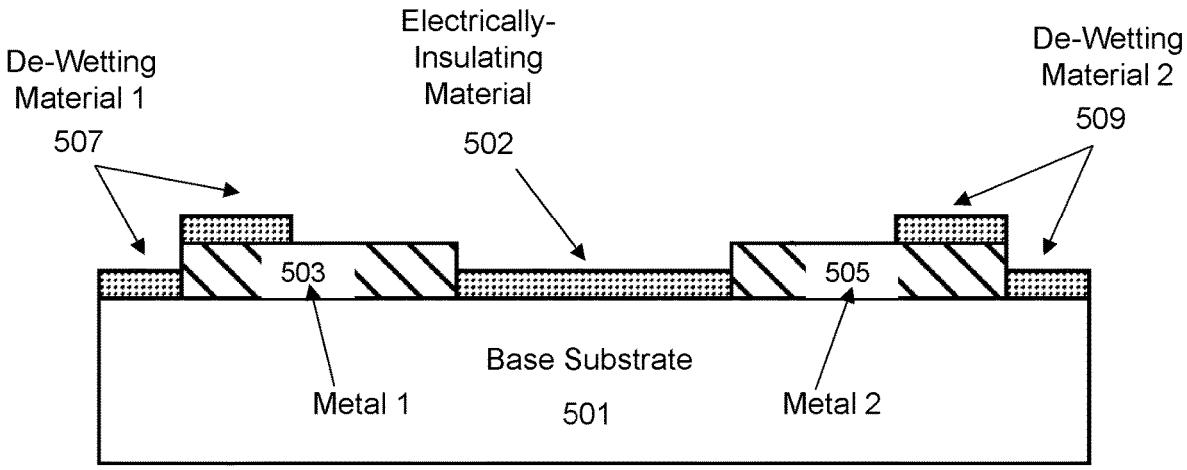

Moreover, as shown in FIG. 5B, the second step (500B) of this embodiment involves depositing a first de-wetting material coating (507) on an outer portion of the first metal pad (503), and depositing a second de-wetting material coating (509) on an outer portion of the second metal pad (505). The first de-wetting material coating (507) and the second de-wetting material coating (509) can be made of same materials, such as polymer films. In addition, an electrically-insulating material (502) is also deposited between the first metal pad (503) and the second metal pad (505), as shown in FIG. 5B. In one embodiment of the invention, the electrically-insulating material (502) may be the same chemical substance used in de-wetting material coating. In another embodiment of the invention, the electrically-insulating material (502) may be a specialized dielectric material for effective electric insulation between the two metal pads (503, 505).

Figure 5C:
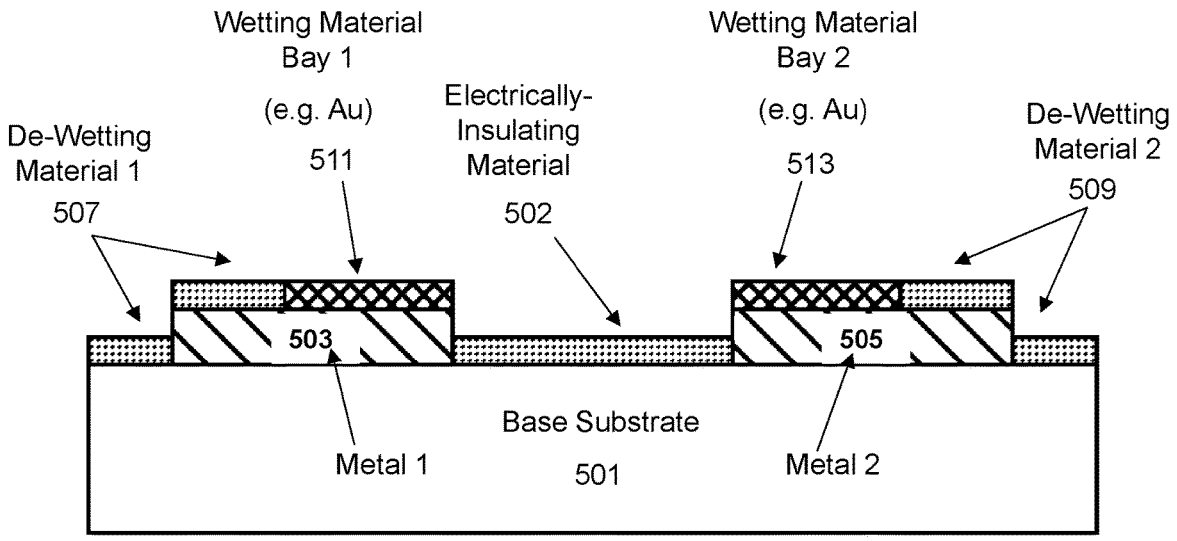

Furthermore, as shown in FIG. 5C, the third step (500C) of this embodiment involves depositing a first wetting material bay (511) on an inner (i.e. remaining) portion of the first metal pad (503), and depositing a second wetting material bay (513) on an inner (i.e. remaining) portion of the second metal pad (505). Preferably, the wetting material bays (511, 513) may be made of gold (Au), nickel (Ni), or a combination thereof.

Figure 5D:
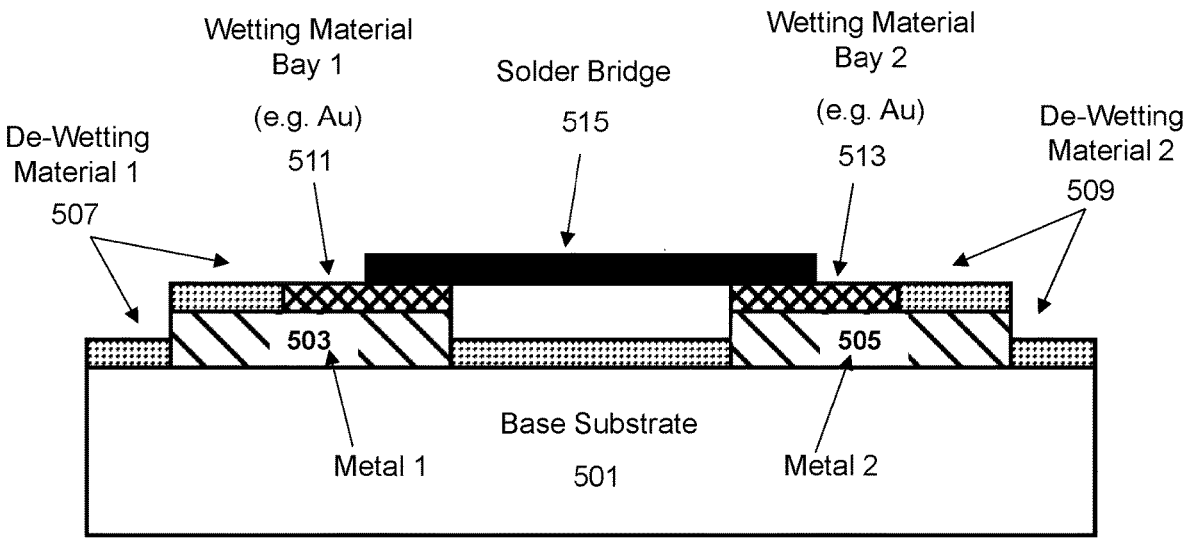

Finally, as shown in FIG. 5D, the fourth step (500D) of this embodiment involves placing a solder bridge (515) or a solder ball across the first wetting material bay (511) and the second wetting material bay (513), wherein the solder bridge (515) or the solder ball forms a gap with the electrically-insulating material (502) that separates the first metal pad (503) and the second metal pad (505). Although the solder bridge (515) is illustrated in association with FIG. 5D, other embodiments of the invention may utilize the solder ball (e.g. 713 in FIG. 7C) as a bridge, as illustrated in FIG. 7C.

Figure 6A:
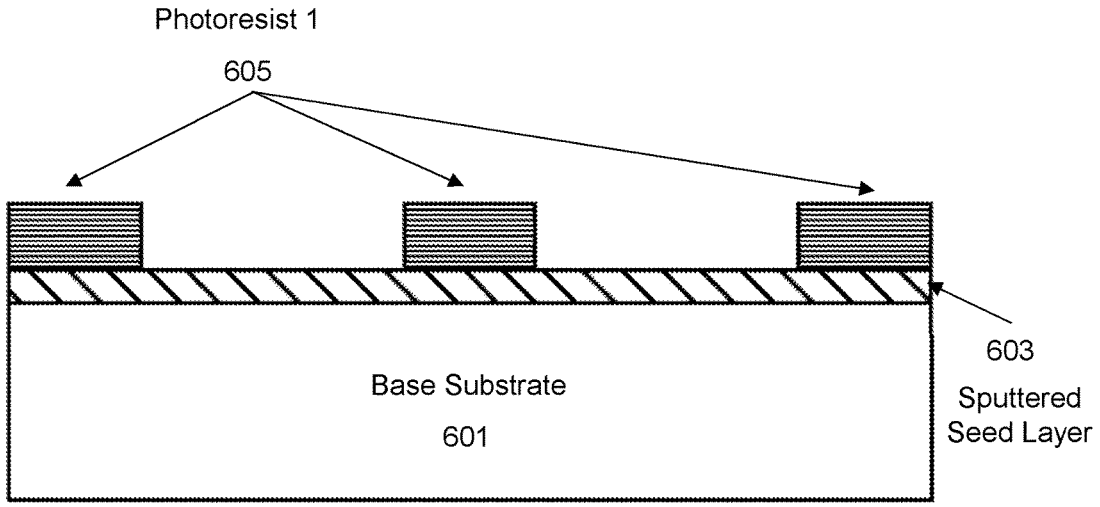
FIG. 6A~FIG. 6F show a series of plating manufacturing-based processing steps for fabricating a novel temperature-triggered fuse device, in accordance with an embodiment of the invention.

FIG. 6A~FIG. 6F show a series of plating manufacturing-based processing steps for fabricating a novel temperature-triggered fuse device, in accordance with an embodiment of the invention. As shown in FIG. 6A, the first step (600A) of this embodiment involves sputtering a base seed layer (603) on top of a base substrate (601), applying a photoresist (605) on the base seed layer (603), and forming patterns on the photoresist (605) by utilizing a photomask. By forming the patterns on the photoresist (605), multiple pieces of base seed layers that should not be etched away in a later processing are identified.

Figure 6B:
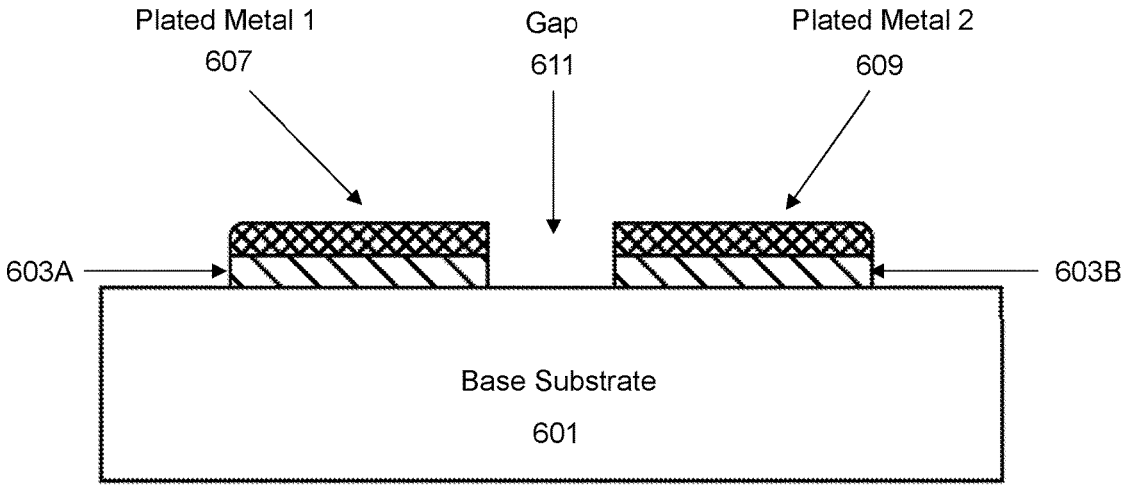

Then, as shown in FIG. 6B, the second step (600B) of this embodiment involves plating a first metal pad (607) on a first piece (603A) of the base seed layer (603), and also plating a second metal pad (609) on a second piece (603B) of the base seed layer (603). Subsequently, areas covered by the patterned photoresist (605) are etched to remove corresponding underlying portions of the base seed layer, and the top surface of the structure is cleaned from photoresist residues to look like the device structure as shown in FIG. 6B. After the etching process, a gap (611) is formed between the first metal pad (607) and the second metal pad (609).

Figure 6C:
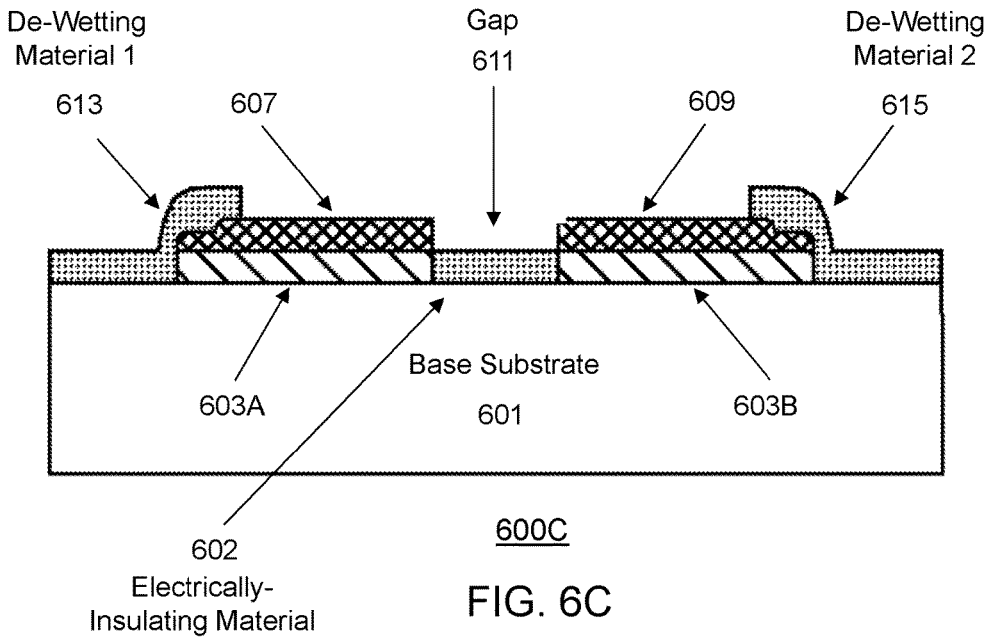

The third step (600C) of this embodiment involves depositing a de-wetting material coating on a topmost surface, and applying a passivation mask to identify metal exposure locations on the first metal pad (607) and the second metal pad (609) for removal of the de-wetting material coating. Then, the de-wetting material coating from the metal exposure locations is etched away to create a device structure that has a first piece (613) of the de-wetting material coating covering an outer perimeter of the first metal pad (607), and a second piece (615) of the de-wetting material coating covering an outer perimeter of the second metal pad (609), as shown in FIG. 6C. The metal exposure locations (i.e. inner top surfaces of 607 and 609) are then cleaned from photoresist and etch residues.

Figure 6D:
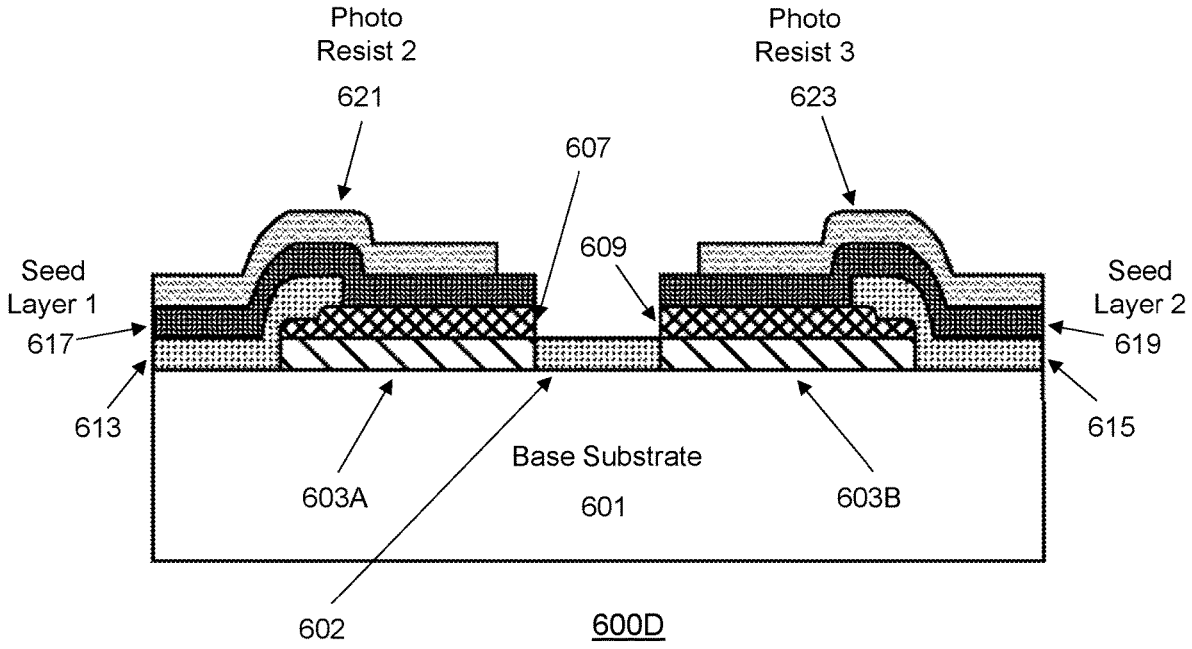

Then, the fourth step (600D) of this embodiment involves depositing a wetting bay seed layer on the topmost surface of the device structure, and applying a gap mask to identify the gap separating the first piece (603A) of the base seed layer and the second piece (603B) of the base seed layer for removal of a portion of the wetting bay seed layer above the gap (611). Subsequently, the portion of the wetting bay seed layer above the gap (611) is etched away, which creates a first piece (617) of the wetting bay seed layer and a second piece (619) of the wetting bay seed layer, as shown in FIG. 6D. Furthermore, a solder bridge mask is applied to create new photoresist patterns (621, 623) to identify a solder bridge location, as also shown by the device structure in FIG. 6D.

Figure 6E:
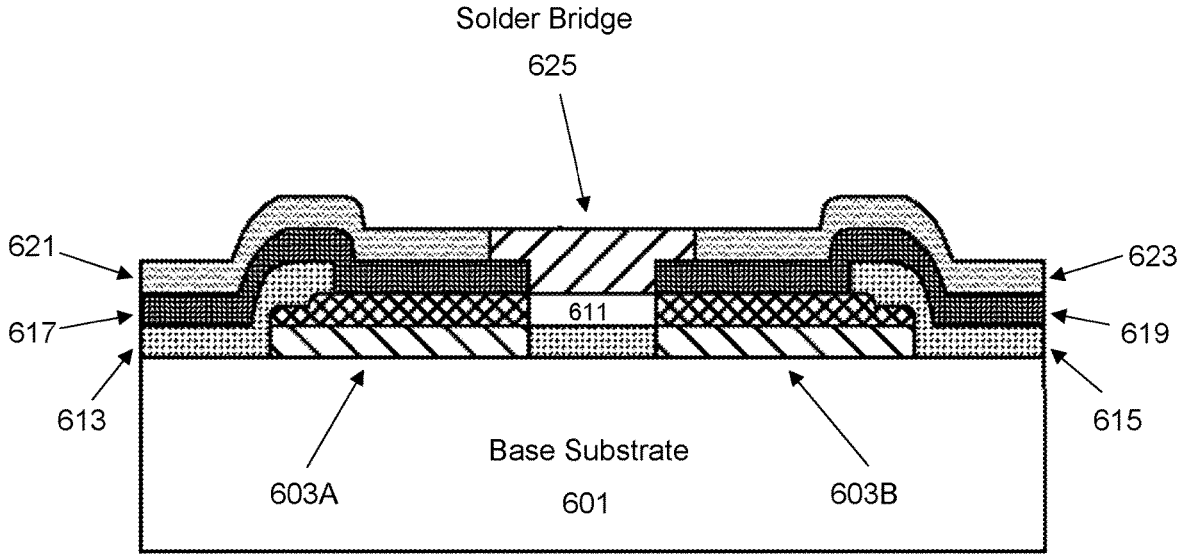
Figure 6F:
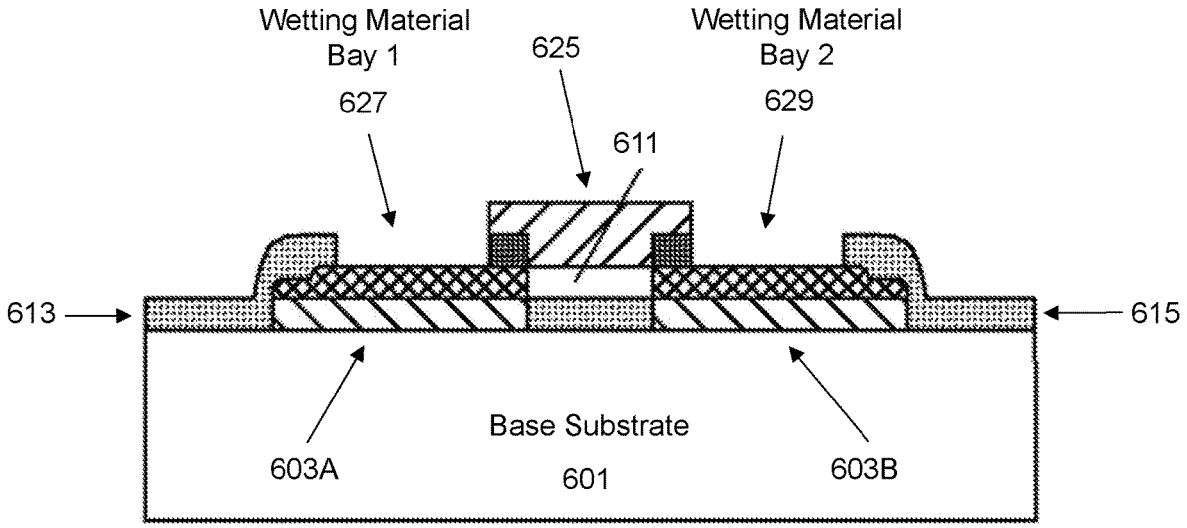

The fifth step (600E) of this embodiment involves plating solder to form the solder bridge (625) at the solder bridge location across the gap (611), wherein the solder bridge (625) connects separated pieces (617, 619) of the wetting bay seed layer, as shown in FIG. 6E. Finally, the sixth step (600F) of this embodiment involves etching portions of the wetting bay seed layer (617, 619) above the de-wetting material coating pieces (613, 615) and the plated metals (607, 609), and cleaning the topmost surface to create the completed device structure for the novel temperature-triggered fuse device, as shown in FIG. 6F.

Figure 7A:
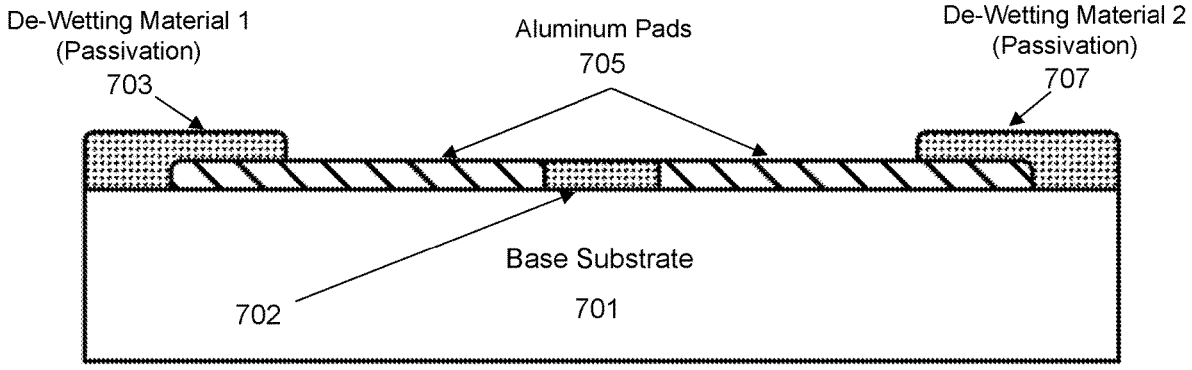
FIG. 7A~FIG. 7C show a series of electroless nickel gold plating-based processing steps for fabricating a novel temperature-triggered fuse device, in accordance with an embodiment of the invention.
Figure 7B:
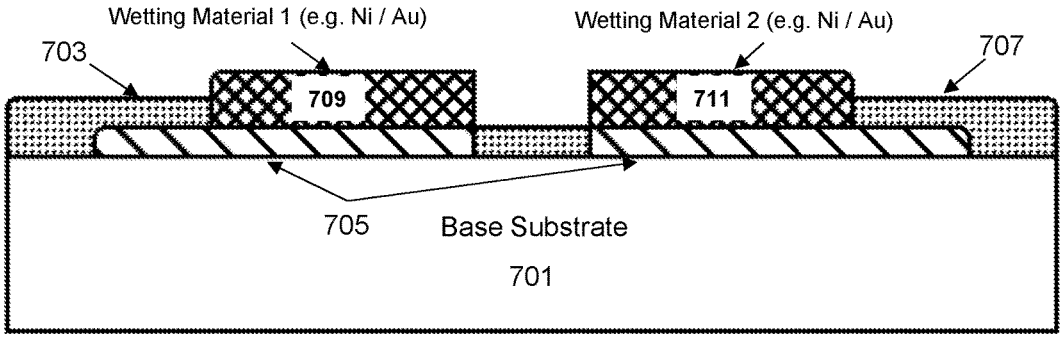
Figure 7C:
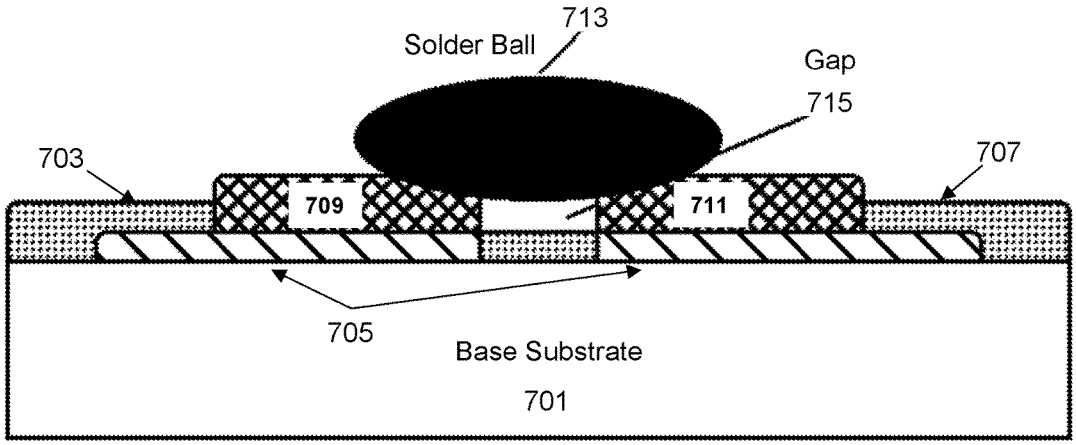

FIG. 7A~FIG. 7C show a series of electroless nickel gold plating-based processing steps for fabricating a novel temperature-triggered fuse device, in accordance with an embodiment of the invention. As shown in FIG. 7A, the first step (700A) of this embodiment involves placing two aluminum pads (705) on top of a base substrate (701). Typically, the base substrate (701) is made of silicon, ceramic, silicon dioxide, or a printed circuit board (PCB) material.

Then, a first de-wetting material coating (703) is deposited on an outer portion of the first aluminum pad, and a second de-wetting material coating (707) is deposited on an outer portion of the second aluminum pad. The first de-wetting material coating (703) and the second de-wetting material coating (707) can be made of same materials, such as polymer films. In addition, an electrically-insulating material (702) is also deposited between the first aluminum pad and the second aluminum pad, as shown in FIG. 7A. In one embodiment of the invention, the electrically-insulating material (702) may be the same chemical substance used in de-wetting material coating. In another embodiment of the invention, the electrically-insulating material (702) may be a specialized dielectric material for effective electric insulation between the two aluminum pads.

Furthermore, as shown in FIG. 7B, the second step (700B) of this embodiment involves plating a first wetting material bay (709) on an inner (i.e. remaining) portion of the first aluminum pad, and also plating a second wetting material bay (711) on an inner (i.e. remaining) portion of the second aluminum pad. Preferably, the wetting material bays (709, 711) may be made of gold (Au), nickel (Ni), or a combination thereof.

Finally, as shown in FIG. 7C, the third step (700C) of this embodiment involves placing a solder ball (713) across the first wetting material bay (709) and the second wetting material bay (711), wherein the solder ball (713) forms a gap (715) with the electrically-insulating material (702) that separates the first aluminum pad and the second aluminum pad. The completed device structure that utilized the electroless nickel gold plating method to produce the novel temperature-triggered fuse device is shown in FIG. 7C.

Various embodiments of a temperature-triggered fuse device and related methods of manufacturing the device have been illustrated in FIGS. 1-7 and described above. The present invention provides numerous advantages over conventional power protection fuse designs. For example, a novel temperature-triggered fuse device produced in accordance with an embodiment of the present invention enables real-time temperature-triggered circuit and device protection at a specified ambient threshold temperature near the novel fuse device, unlike conventional fuses that only get triggered after a current or voltage surge. In particular, conventional fuses may be insufficient or inaccurate in tracking or detecting a thermal runway condition that may damage or destroy an electronic device.

In contrast, the novel temperature-triggered fuse device disclosed in various embodiments of the present invention accurately tracks a rise in ambient temperature near the location of the fuse, and the fuse is rapidly triggered to disconnect the fuse-enabled circuitry and electronic components when the rise in ambient temperature meets or exceeds the specified ambient threshold temperature. Furthermore, a fuse designer is able to precisely define a desired ambient threshold temperature by customizing material selection and mix for the wetting material bays and by fine-tuning the dimensions of a solder bridge or a solder ball, which is utilized to connect a pair of wetting material bays.

Furthermore, the novel temperature-triggered fuse device disclosed in various embodiments of the present invention can be readily integrated into conventional IC designs, and various manufacturing steps disclosed herein for production of the novel temperature-triggered fuse device enable easy integration of this novel fuse design into many different types of IC's, discrete components, and other electronic devices.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for producing a temperature-triggered fuse device, the method comprising the steps of:

placing a first metal pad and a second metal pad on top of a base substrate, wherein the first metal pad and the second metal pad are separated by a gap formed on the base substrate;

depositing an electrically-insulating de-wetting film on top of the base substrate and below the gap;

depositing a first de-wetting material coating on a portion of the first metal pad and a second de-wetting material coating on a portion of the second metal pad;

depositing a first wetting material bay on a remaining portion of the first metal pad and a second wetting material bay on a remaining portion of the second metal pad; and placing a solder bridge or a solder ball on top of an inner segment of the first wetting material bay and an inner segment of the second wetting material bay across the gap on the base substrate coated with the electrically-insulating de-wetting film.

2. The method of claim 1, wherein the first wetting material bay and the second wetting material bay are made of gold, nickel, copper, or a combination thereof.

3. The method of claim 1, wherein the first de-wetting material coating and the second de-wetting material coating are made of polymer films.

4. The method of claim 1, wherein the first metal pad and the second metal pad are made of aluminum or copper.

5. The method of claim 1, wherein the base substrate is silicon, silicon dioxide, or a printed circuit board.

* * * * *